US005507496A

United States Patent [19]

Yeung

[11] Patent Number: 5,507,496

[45] Date of Patent: Apr. 16, 1996

[54] OSCILLATING PLATFORM FOR A SHOOTING RANGE

[76] Inventor: Peter S. K. Yeung, 1448 Harts Mill Rd., N.E., Atlanta, Ga. 30319

[21] Appl. No.: 97,536

[22] Filed: Jul. 27, 1993

[51] Int. Cl.[6] ..... F41J 1/00

[52] U.S. Cl. ..... 273/348; 273/356; 273/369; 273/381

[58] Field of Search ..... 273/348, 356, 273/359, 355, 366, 367, 369, 371, 381; 472/135, 43, 31, 36; 108/20, 22, 21

[56] References Cited

U.S. PATENT DOCUMENTS

| | | | |
|---|---|---|---|
| Re. 12,435 | 1/1906 | Weidner | 472/43 |
| D. 217,375 | 4/1970 | Lohr et al. . | |
| 732,341 | 6/1903 | Devine | 108/22 |
| 871,190 | 11/1907 | Shortill | 108/21 |
| 910,403 | 1/1909 | DeMartino | 472/36 |
| 1,078,645 | 11/1913 | Shamroy | 472/31 |
| 1,167,650 | 1/1916 | Nachtigall | 472/43 |
| 1,280,679 | 10/1918 | D'Erriko | 472/31 |
| 2,130,175 | 12/1937 | Prins | 108/22 |
| 2,138,730 | 1/1938 | Cooper | 108/21 |
| 2,324,343 | 7/1943 | Wharton | 108/22 |
| 2,855,916 | 10/1958 | Foster . | |
| 3,030,949 | 4/1962 | Gassaway . | |
| 4,605,224 | 8/1986 | Torii . | |
| 5,114,154 | 5/1992 | Sellner | 472/31 |

*Primary Examiner*—Mark S. Graham
*Attorney, Agent, or Firm*—Hopkins & Thomas

[57] ABSTRACT

A running target shooting range comprising an oscillating platform 21, wherein a marksman stands thereon so as to position himself or herself to fire bullets at a stationary target (not shown). The oscillating platform 21 is supported on and moves by rollers or wheels 31 which are positioned in a stationary base member 25 located below the surface of the oscillating platform 21. Pivot arm 32 engages both the stationary base member 25 and the oscillating platform 21 at a generally central location, wherein the platform is oscillatable about the pivot arm 32 when a drive mechanism, also housed in the stationary base member 25 is activated. The drive mechanism 80 comprises a gearmotor 81, which propels a rotary shaft 82 having one end engaging the motor and the other end including a small-toothed pinion wheel 84, and wherein the teeth on the pinion wheel 84 mate with matching teeth on the bottom side of a cam system when the shaft is rotated. The gearmotor 81, therefore, rotates the shaft 82, which propels the pinion wheel 84 to translate a rotational force to the cam disk 36. Additionally, the cam system 60 includes a cam follower 42. While the cam disk 36 rotates, the cam follower 42, following one of the two cams, 66 or 68, transfers the force to the platform 32, thus, causing the platform to oscillate in a specific pattern. Therefore, the present invention trains and provides the same sensation to the marksman as if the target is moving and the platform is stationary.

21 Claims, 6 Drawing Sheets

OSCILLATING PLATFORM FOR A SHOOTING RANGE

FIELD OF THE INVENTION

The present invention relates generally to devices used in target shooting ranges, and more particularly to an oscillating platform for a simulated running target shooting range.

BACKGROUND OF THE INVENTION

Target shooting has long amused and entertained both youngsters and adults, alike, as well as being a training vehicle for military and police use. One example of target shooting relates to trap shooting, such as "skeet" shooting, wherein target traps are used to eject disk targets known as clay pigeons. For instance, U.S. Pat. No. 2,855,916 to Foster discloses a mobile apparatus for an attendant of a skeet shooting event to control electronically the target releasing traps, while the attendant is also able to simultaneously tabulate the scores of the marksman.

Stationary target shooting is another type of shooting activity for a marksman. This type of target shooting can function as firing simulation for training law enforcement agents, as well as for entertainment, such as in a sporting event. For example, target shooting is a standard sport in the Olympic games. In a stationary target shooting environment, a marksman standing behind a table or a bench of a predetermined height, and at a predetermined distance from the target, aims and then fires a series of shots at the target. Hence, a certain amount of time is allocated for the marksman to shoot at the target, wherein a score is tabulated by examining the placements of the bullet marks so as to determine the precision and accuracy with which the marksman fired the shots.

A variation of the target shooting is a running target shooting event, wherein one or several mobile targets are propelled across an opening or "window" at which time a participant is permitted to fire at the target or plurality of targets. Examples of running target shooting games exist at a variety of different places, such as shooting galleries at amusement parks, arcades, and the like. In these types of shooting galleries, the targets usually comprise a plurality of objects, such as ducks moving laterally from one side to the other side. The targets are usually propelled by means of a rotary track, wherein a participant is positioned a predetermined distance away from the targets and has a certain period of time in which to fire bullets at the targets. Normally, each target will fall down or otherwise vindicate when the participant has successfully hit the target.

In the sport of Olympic or NRA sanctioned running target shooting, there are two categories of competition: the 10 meter and 50 meter ranges. Thus, the marksman can shoot from 10 meters or from 50 meters away depending upon which competition is taking place. This distance is measured from the edge of the bench or table nearest the marksman to the target when it is in the center of the opening. The opening is defined as the space between two walls or the "window" in which the target is visible to the marksman. In the 50 meter range, the width of the opening is 10 meters wide, wherein the target is visible. In the 10 meter range, the "window" is 2 meters wide.

In addition, competition rules require that the target be printed in one color and that it have an illustration of an animal thereon, such as a boar. The target includes a series of scoring rings superimposed thereon with the values of 1 through 10 clearly printed on each of the rings. Further, the movement of the target laterally across the opening is called a "run", wherein the following two different run speeds are used in competition: the slow run and the fast run. For a slow run, the time period in which the marksman is allowed to fire at the target is between 5 and 5.2 seconds. For a fast run, the time period allowed to fire at the target is between 2.5 and 2.6 seconds. Timing of the run begins when the target is first visible, and ends when the leading portion of the target reaches the opposite wall. Very specific rules are promulgated by the National Rifle Association (NRA) and the international bodies as to how the running target shooting game should be organized.

Although running target shooting is an official Olympic game, there are less than 10 indoor target shooting ranges in the entire United States available for running target shooting practice. While the 50 meter running target shooting is a very popular sport in the European countries, it is not common in the United States due mainly to a lack of training facilities. A typical running target shooting range comprises a target placed on a trolley system which runs laterally back and forth on rails or cable and is driven by a motor. This type of arrangement allows the target to move laterally while the marksman remains stationary. The systems used in shooting galleries in arcades and amusement parks is generally equivalent in nature to the system of a typical running target shooting range. Only the scope and dimensions vary from one type of range to the other. The term running target shooting range is therefore meant to include the other types of running target games, such as those found in shooting galleries.

In the prior art, running target shooting games and ranges, such as those discussed above, appear to be somewhat successful in providing ranges for running target shooting, they nevertheless exhibit various problems and shortcomings that are inherent in their respective designs. For instance, the prior art running target shooting range assembly requires a great deal of space and is usually fixed in place at a particular range. In other words, it would be difficult to convert a stationary target range to a running target range because of the limitations of space and the mechanical assembly that the running target would require. The minimum amount of space that a 50 meter running target range would require to operate according to the official rules could accommodate ten stationary target shooting positions. This factor appears to be the main reason why so few indoor 50 meter running target shooting ranges are available in the entire United States.

Thus, a need exists for an improved running target range and system that overcomes the problems and shortcomings of the prior art such as the space limitations.

SUMMARY OF THE INVENTION

Briefly described, the present invention, in a preferred embodiment thereof, comprises a simulated running target shooting range system including an oscillating platform upon which the marksman stands and a stationary target. When a marksman is standing on the platform and takes aim at the fixed target, the turning movement of the platform would force him to turn his body in order to keep his aim at the target and shoot as if he were shooting at a moving target. Simulation is thus achieved.

The oscillating platform assembly is generally rectangular in shape and is supported by wheels on a stationary base member of smaller size than the overlapping platform. The stationary base member houses the drive mechanism used to oscillate the platform, as well as accommodating the other mechanisms required to simulate a standard running target shooting range.

A pivot arm engages both the stationary base and the platform at a generally central location. The platform, therefore, is oscillatable or rotatable about the pivot arm when the drive mechanism is activated. The drive mechanism comprises a gearmotor, which drives a rotary shaft, partially running through the gearmotor. One end of the shaft has mounted thereon a small-toothed pinion wheel, wherein the teeth on the wheel mate with matching teeth on the bottom side of a cam system when the shaft is rotated. The gearmotor, therefore, rotates the shaft, which rotates the pinion wheel to translate a rotational force to the cam system.

The cam system of the present invention dictates both the degrees of oscillation and the rate of motion for the oscillating platform, and comprises a set of two cam grooves, having generally an elliptical profile.

The larger and smaller cams are machined to a similar predetermined profile, and as the cams are rotated by the gearmotor and pinion system, such a movement imparts a linear motion to a cam follower which in turn, imparts an oscillatory movement to the movable platform. The cam follower, therefore, is connected only to the oscillating platform. The larger profile for the cam imparts a slower oscillatory movement, and likewise, the smaller cam imparts a faster oscillatory movement to the platform. Hence, when the cam follower is following the profile of the large cam, a slow "run" of the running target system is simulated, and when the cam follower is following the profile of the small cam, the fast run of the running target is simulated. In order to change from one speed to another, the cam follower is manually positioned to engage the profile of the large or small cam, respectively.

Typically, when using the present invention in a running target shooting game environment, a game comprises a series of slow or fast runs allowing the marksman a 40 second period of time per cycle of two runs. For a fast run period, the marksman is allowed approximately 12.5 seconds stationary time, and 7.5 seconds clockwise turning time, whereby for 2.5 seconds of that time the target is visible by way of illumination of the target, and another 12.5 seconds stationary time, and 7.5 seconds counterclockwise time, whereby for another 2.5 seconds the target is again visible. For a slow run period, the marksman is allowed approximately 7.5 seconds stationary time and 12.5 seconds counterclockwise turning time, whereby for 5 seconds the target is visible, then, another 7.5 seconds stationary time, and finally a last 12.5 seconds clockwise turning time with the target visible for 5 seconds.

A set of casters or rollers supports the platform so that with this arrangement, the platform becomes free to rotate in an oscillating fashion when the drive mechanism rotates the cam system and activates the cam follower. In addition, the oscillating platform includes a table mounted thereon as required by the NRA rules. Further, a pair of support members for sustaining the table are positioned one on each side of the table and attached to the oscillating platform.

An audio and or visual circuit can be correlated with the system to provide an audible and visible cue to the marksman as to when the marksman is about to fire at the target. In addition, illumination means, such as light, illuminates the target during the time period which the marksman is allowed to shoot. Furthermore, conventional signalling lights, such as red and green lights can be included on the rear side of the platform so as to provide an attendant, such as a referee, a basis for supervising the game.

Accordingly, this invention provides unlimited opportunity for owners of present day indoor firing ranges to accommodate marksmen and students alike to participate in this sport of running target shooting. This invention is rugged, simple and inexpensive to construct, reliable, movable, and does not require the use of a sizable amount of space. Nevertheless, the system trains and provides the same sensation to the marksman as when the target is moving and the platform is stationary.

A more complete understanding of the present invention will be had by those skilled in the art, as well as an appreciation of these and of additional features and advantages, which will become apparent upon reading the detailed description of the preferred embodiment and examining the drawing, a brief description of which follows.

DETAILED DESCRIPTION OF THE PREFERRED EMBODIMENT

Figure 1:
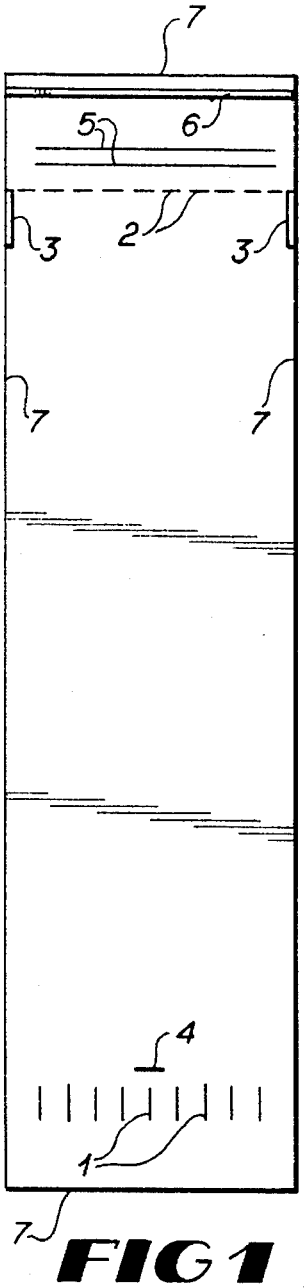
FIG. 1 is a plan of a typical 50 meter fixed target indoor firing range.
Figure 2:
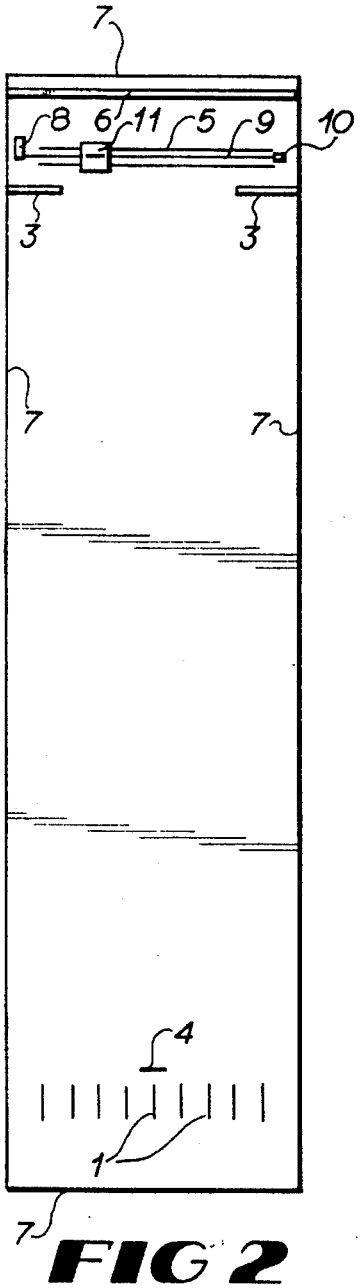
FIG. 2 is a plan view similar to the range of FIG. 1 but used as a traditional running target range.

Referring now in more detail to the drawings in which like numerals refer to like parts throughout the several views, FIGS. 1 and 2 show a typical present day 10-position 50 meter firing range equipped with a running target system in an indoor target shooting facility. A facility can have one or more ranges with any number of firing positions. The facility will also have lobby, gun shop, spectator's area, lounge, restrooms, etc. A range typically will include position markings or partitions 1 for fixed targets 2, swing walls 3, marking for moving target shooter 4, built-in rail tracks 5, bullet trap 6 and walls 7 and doors not shown. When this range is used for running target, motor 8, cable 9, pulley 10 and target carrier 11 will have to be brought in to operate the running target, and the swing wall 3 be in a closed position to provide proper opening for the running target to be seen travelling at a set distance (10 meters). Only one marksman can use the range at one time.

Figure 3:
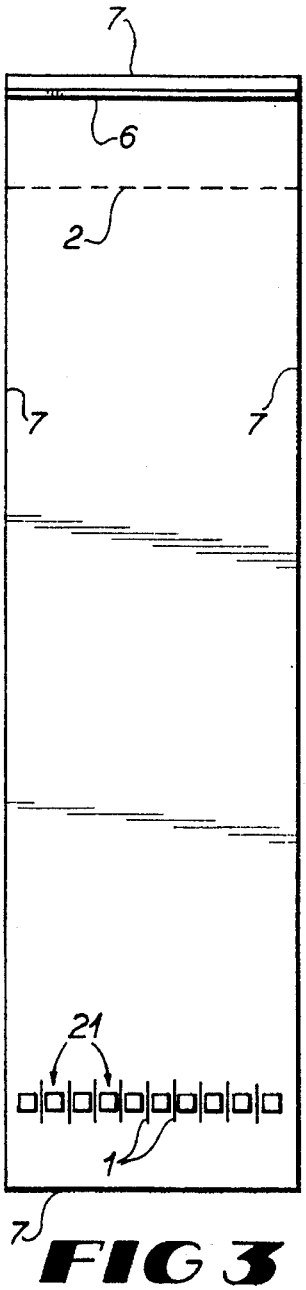
FIG. 3 is a plan view of the present invention showing ten shooters using the invention.

FIG. 3 shows a range of the same size as that shown in FIG. 1. By using the oscillating platforms 21, ten marksmen can use the range at the same time, while rail tracks and swing wall will not have to be built into building.

Figure 4:
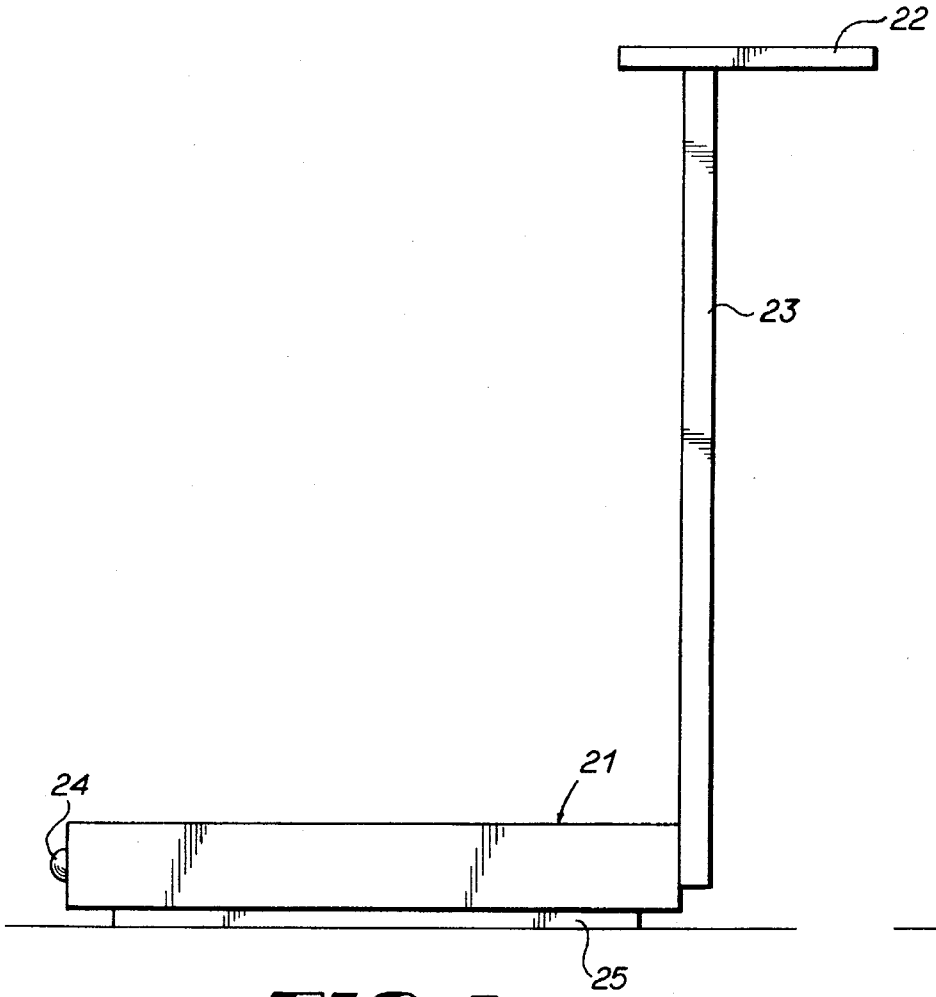
FIG. 4 is a side elevational view of the oscillating platform of the present invention.

FIG. 4 shows a side elevation of an oscillating platform 21, table 22, table support 23 attached to oscillating platform, visual signals 24 and a stationary base 25.

Figure 5:
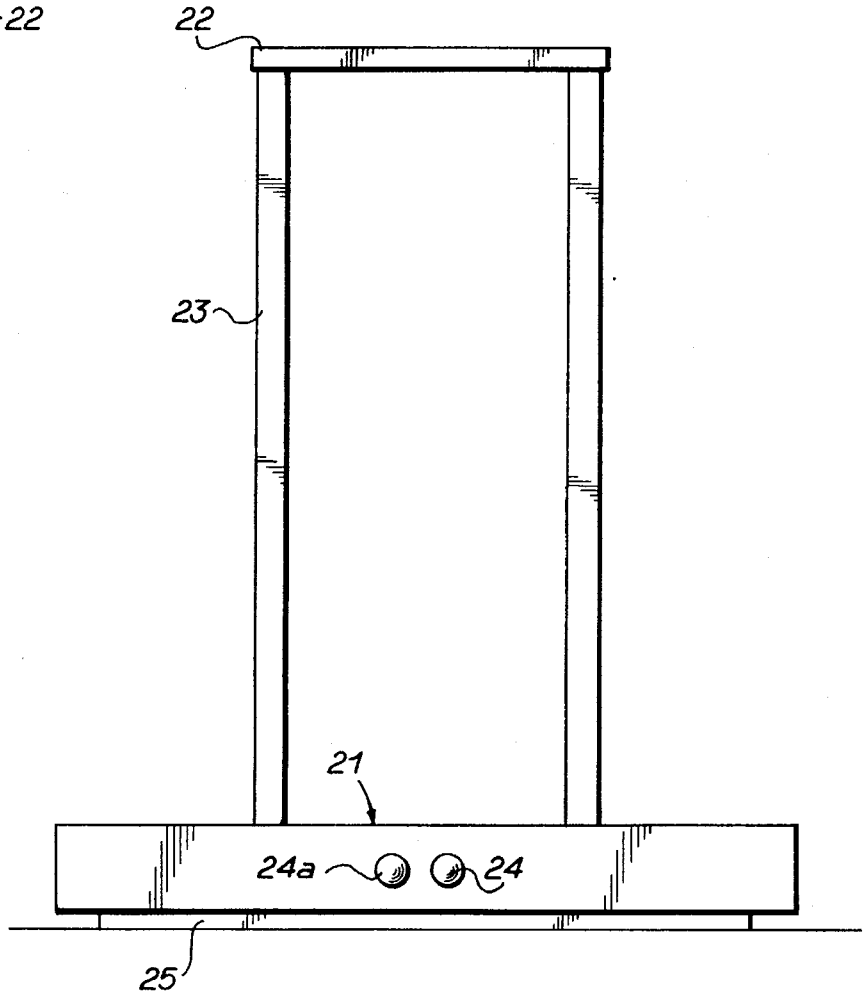
FIG. 5 is a rear elevational view of the oscillating platform of the present invention.

FIG. 5 shows a rear elevation view of the oscillating platform 21, table 22, table supports 23 attached to oscillating platform, visual signal 24 and stationary base 25.

Figure 6:
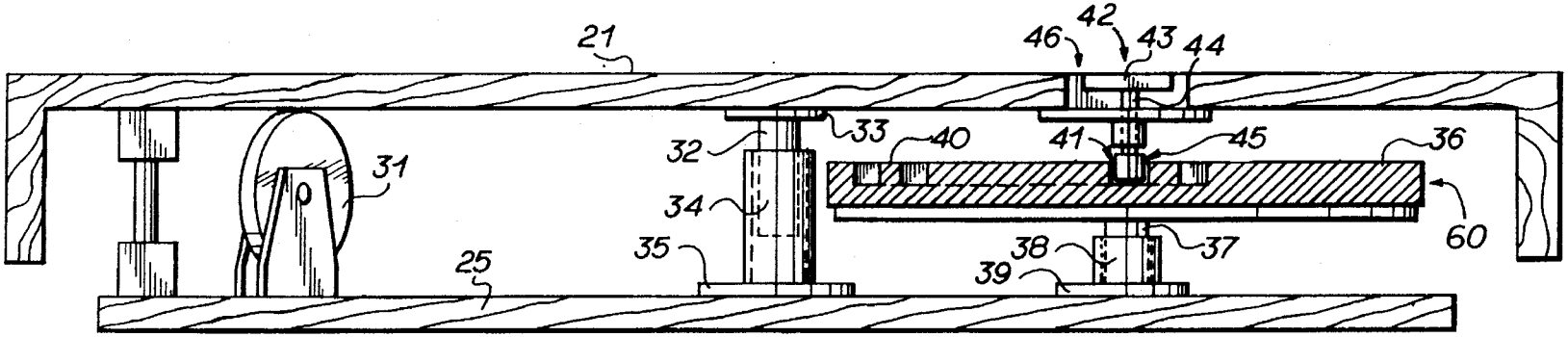
FIG. 6 is a partial side cross-sectional view of the stationary base and the platform of the present invention.

FIG. 6 shows a partial side cross-sectional view of the stationary base 25 and the oscillating platform 21, casters 31, anchored to stationary base and supporting oscillating platform, oscillating platform rotate about pivot arm 32 anchored to oscillating platform with mounting bracket 33, the sleeve 34 for the pivot arm and a mounting bracket 35 anchored to stationary base. In addition, FIG. 6 illustrates a rotary cam system 60 rotatable about a cam pivot 37 which comprises a sleeve 38 on mounting bracket 39 anchored to base 25. The mounting bracket secures a sleeve 34 for registering with a pivot arm 32, which supports a disk 36 having cam members 40 and 41 channel cut thereon, with each cam member having a different predetermined profile for a cam follower 42 to run along the channel of the cam member, and to control the oscillation of the platform. The cam follower 42 comprises a knob 43, which is attached to a shaft 44 having one of its end portions attached to the handle and the other of its end portions attached to a rotary spool 45 for rolling in the channel of the cam members. An opening 46 is provided in the top wall 21 of the platform so as to accommodate the handle 43 of the cam follower. Thus, a marksman is able to manually adjust which cam member he would like to use, which changes the speed of oscillation of the platform 21.

A caster 31 supports the oscillating platform and is secured to the stationary base 25. A plurality of casters are positioned throughout the space 26 so as to support the platform 21 whereby the platform becomes free to rotate when the drive mechanism rotates the cam system 60 which activates the cam follower 42.

Figure 7:
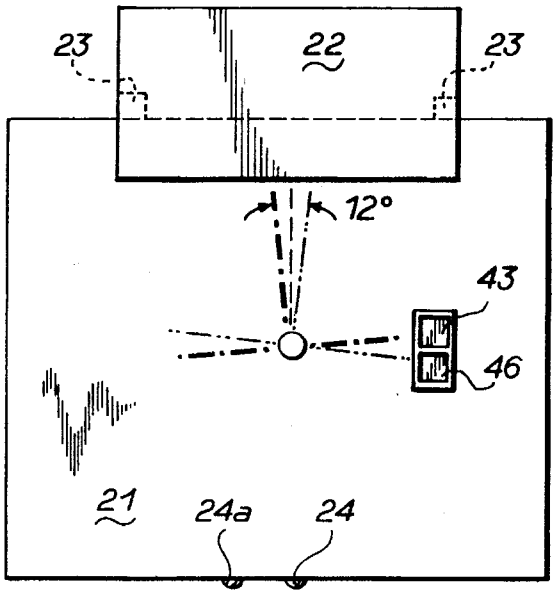
FIG. 7 is a top view of the oscillating platform of the present invention illustrating the manually operated cam follower.

FIG. 7 illustrates a top view of the platform 21, as well as the positioning of the cam follower and the cam follower handle 43. The aperture 46, formed in the top wall of the platform 21 illustrates that a marksman can manually adjust the knob 43 of the cam follower to select the speed of oscillation of the platform.

Figure 8:
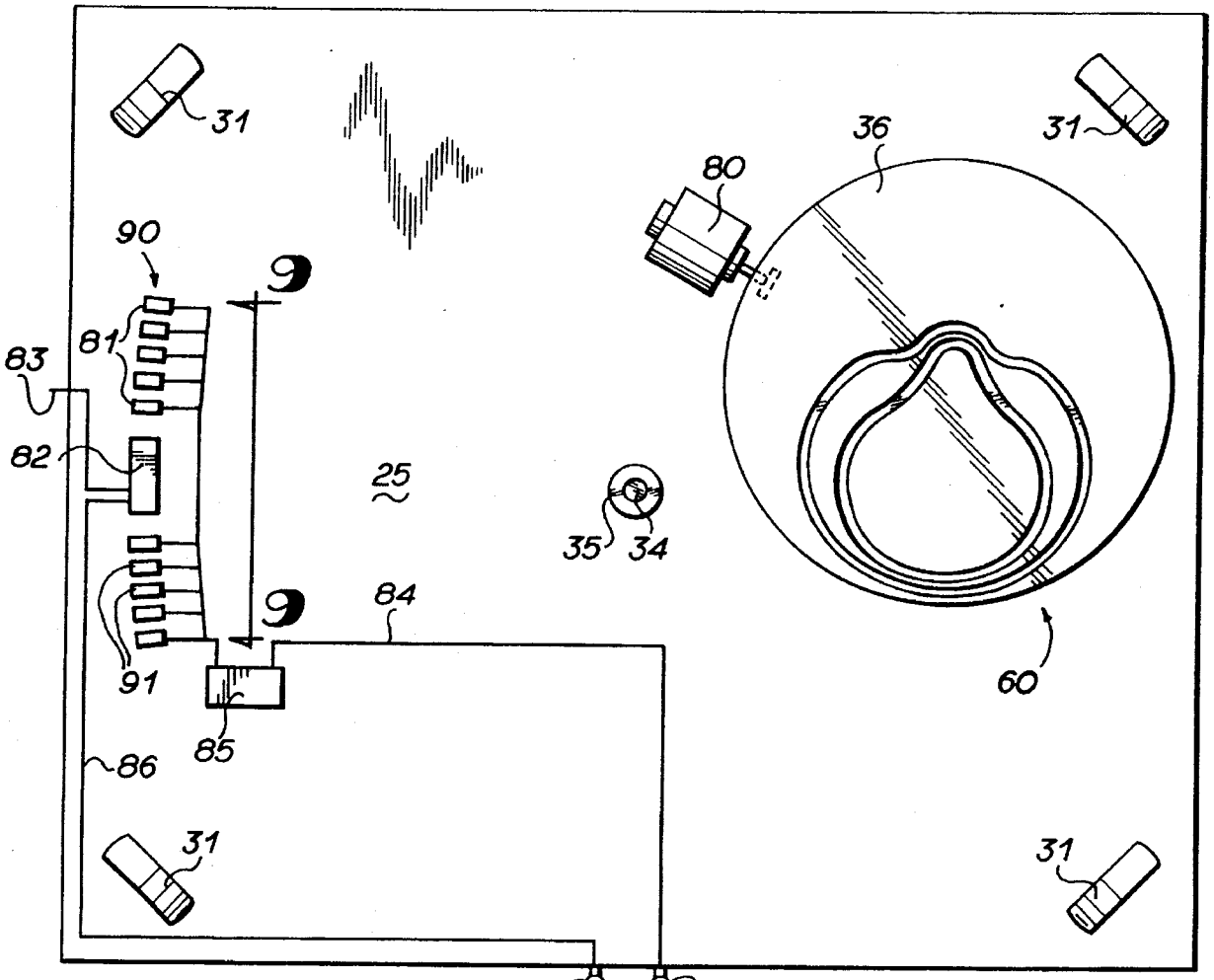
FIG. 8 is a top view of the stationary base of the present invention with the oscillating platform cut away.

FIG. 8 shows a top view of the stationary base 25 wherein the cam system 60 of FIG. 6 is shown in the top view as well. The rotary cam system 60 is shown driven by a drive 80 and is rotatable about a pivot when the drive mechanism 80 is activated.

Figure 9:
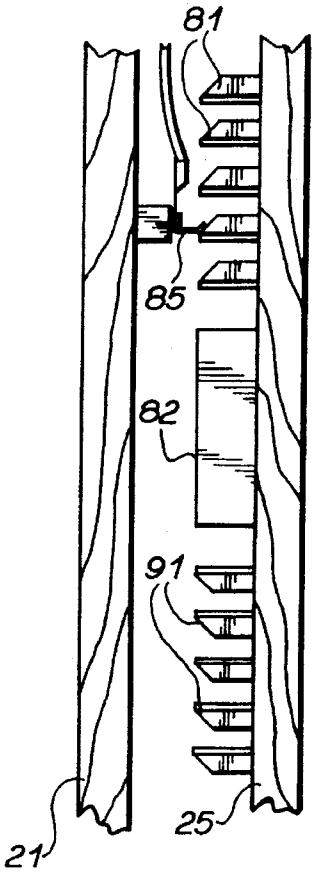
FIG. 9 is an exploded side elevational view of the signalling mechanism shown in FIG. 7.

In addition, FIGS. 8 and 9 show an audio and visual signalling device 90, wherein FIG. 9 illustrates an exposed side elevation view of the signalling device 90. A plurality of electrical contacts, such as contact members 81, 82 and 91 are positioned in the base 25 in a substantially vertical position. In addition, a buzzer 85 is mounted on base 25 and signal lights 24 and 24a are mounted on platform wall. A flexible connection FIG. 85 is mounted on bottom side of platform 21. When platform 21 rotates, FIG. 85, having electrical contact therein for coupling with the vertically spaced electrical contacts 81, 82 and 91 on the base 25, sound and illumination signals are being activated. Contact members 81 and 91 will send out signal through electrical wiring 84 to sound buzzer 85 and illuminate light bulb 24 five times warning marksman and observer alike the oncoming time period for shooting. When FIG. 85 came in contact with electrical contact 82, signal transmitted through wiring 83 will illuminate target light (not shown) and wiring 86 will illuminate signal light **24*a*** for the observer.

In addition, FIG. 8 also shows casters 31 supporting moving platform 21 and sleeve 34 and bracket 35 for pivot arm not shown.

Figure 10:
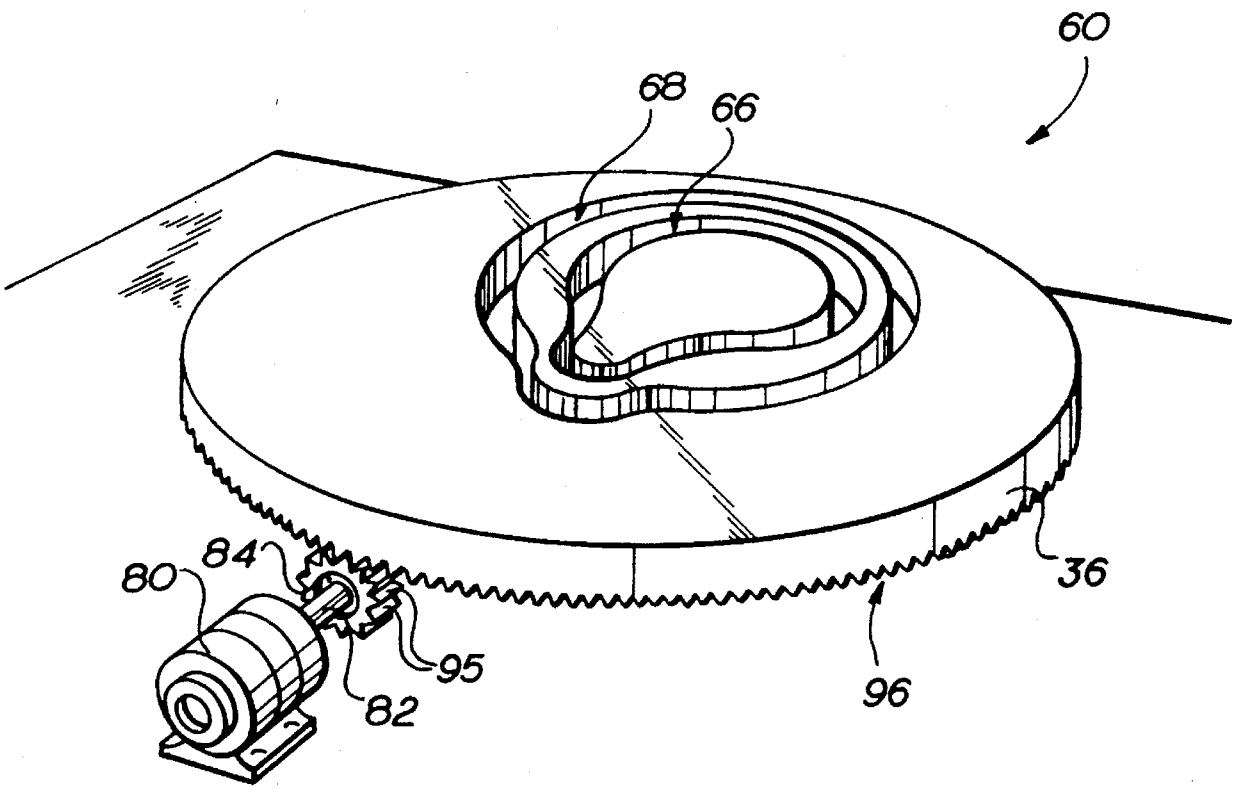
FIG. 10 is an exploded perspective view of the driving mechanism and the cam system of the present invention.

FIG. 10 illustrates a perspective view of the cam system 60 and of a gearmotor 81 of the drive mechanism 80. In particular, the drive shaft 82 of the gearmotor 81 includes a pinion wheel 84 having small teeth 95 there around. The teeth 95 of the pinion wheel 84 match with mating teeth 96 of the rotary disk 36, and propel the disk 36 to rotate when the motor gearmotor 81 is activated. In addition, the large cam member 68 and the smaller cam member 66 are shown in perspective, as well.

Figure 12:
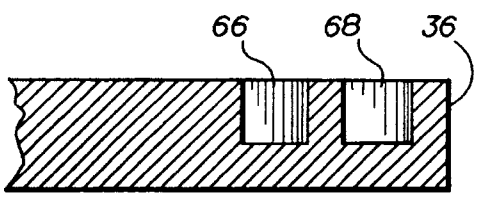
FIG. 12 is a side cross-sectional view of the cam system of FIG. 11.
Figure 11:
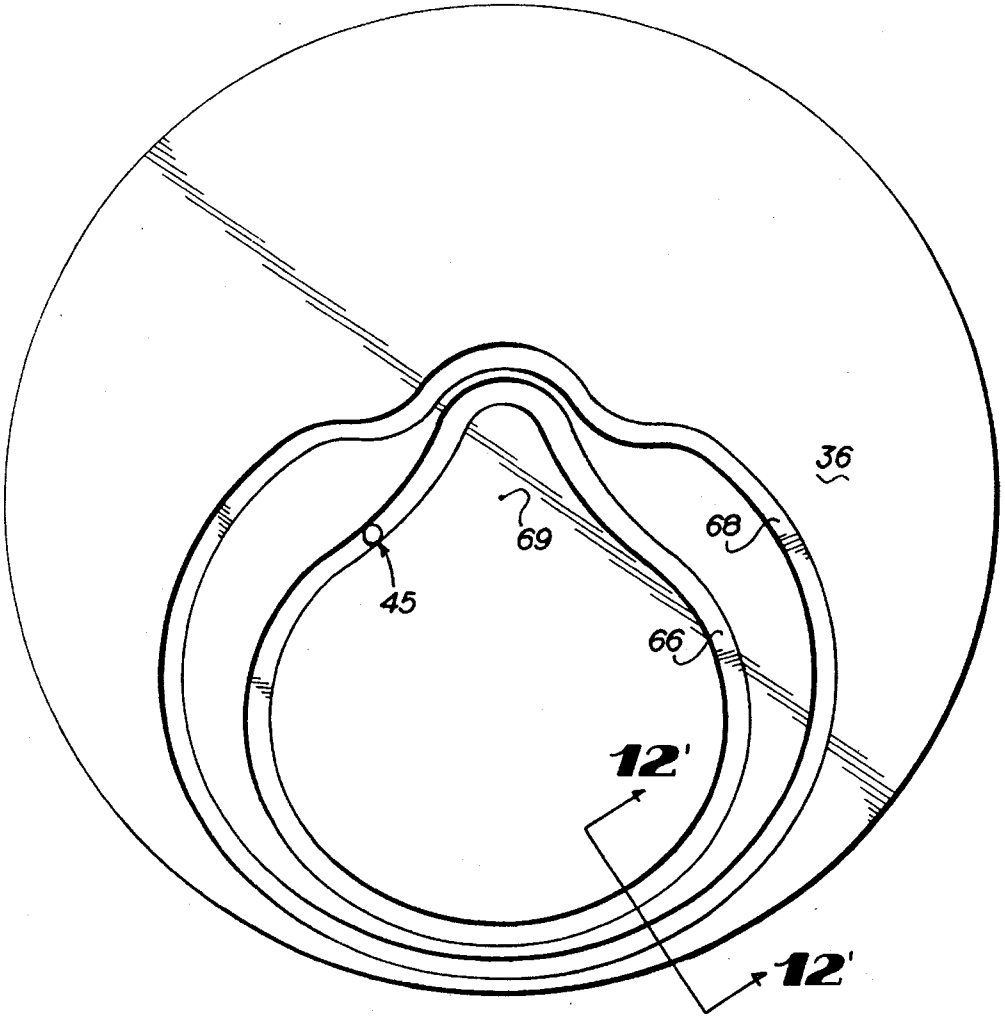
FIG. 11 is a top viewof the cam system of the present invention, showing the two different paths of the cam follower.

FIG. 11 illustrates the pivot point 69, rotary disk 36 of the cam system 60 showing the cam members 66 and 68 in top view. The cam member 68 is the larger cam member, when the cam follower were moving along this profile, the "slow run" of the running target shooting game would be designated. Similarly, if the cam follower were moving along the smaller cam member 66, the "fast run" of the running target shooting game would be designated. Furthermore, FIG. 12 shows a side cross-sectional view of the cam system 60 of the present invention.

Each revolution of the cam follower along each of the cam members is 40 seconds per revolution. Therefore, in a 40 second period of time, the marksman is allowed approximately two periods of stationary time and two periods of oscillating time. For instance, in a fast run period of time, the marksman is allowed approximately 12.5 seconds of stationary time and 7.5 seconds of oscillating time, wherein there are two periods of stationary time and two periods of oscillating time total in one 40 second revolution. Similarly, for a slow run game, the marksman is allowed approximately 7.5 seconds stationary time and 12.5 seconds oscillating time, whereby for 5 seconds the target is exposed. This cycle appears two times during one 40 second revolution.

The present invention has been described herein in terms of a preferred embodiment. It will be clear to those skilled in the art, however, that numerous variations might be made from the illustrated embodiment within the scope of this invention. For example, while the motor and pinion system has been shown for the drive mechanism, other configurations, such as a synchronous motor might also be used with comparable results. Further, while a dual cam system showing a larger cam groove and a smaller cam groove with the use of a cam follower has been shown as a method of oscillating the platform, other configurations might also be used with comparable results. Finally, while the invention has been illustrated in terms of the standard running target shooting game, it will be clear to skilled artisans that the principles of the invention might be applied equally well to any type of shooting gallery, wherein the targets are usually moving and the marksman is usually stationary. Thus, the invention should not be construed to be limited by the running target shooting range configuration of the illustrated embodiment. Of course, these and various other additions, deletions, and modifications might well be made to the preferred embodiment illustrated herein without departing from the spirit and scope of the invention as set forth in the claims.

I claim:

1. A simulated running target shooting system comprising:

a movable platform with a front portion and top and bottom surfaces, a stationary base member having a top surface in a parallel relationship to the bottom surface of said platform, an assembly for moving the platform, means rotatably supporting said platform on said base member and defining an axis of rotation for said platform, said means being located at a central location in the space formed between said base member and said platform, said assembly comprising a drive mechanism for causing sad movable platform to rotatably oscillate about said axis of rotation, and a stationary target located a predetermined distance from said platform and base member, and signaling means including means for providing an indication to a marksman on said platform when the rotating platform is approaching a position for the marksman to fire at said target whereby when the platform oscillates, a marksman on said platform experiences the sensation that the target is moving.

2. The simulated running target shooting system as claimed in claim 1, wherein said means for rotatably supporting said platform comprises roller means located between the top surface of the stationary base member and the bottom surface of the platform, for Supporting said platform so as to allow the platform to oscillate when said drive mechanism is activated.

3. The simulated running target shooting system as claimed in claim 2, wherein said rotatable means comprises a plurality of casters positioned generally at outer edges of said stationary base member.

4. The simulated running target shooting system as claimed in claim 1, wherein said drive mechanism comprises a motor for propelling a rotary shaft having mounted on one end thereof a gear member having a series of teeth there around, the teeth on said gear member mating with teeth on a geared cam system, having one or more members to cause a rotary motion of the members in the cam system when said motor causes said gear member to rotate.

5. The simulated running target shooting system as claimed in claim 4, and further including a cam system comprising a cam disk having cam members with two different profiles, a cam wheel being seated on a cam wheel shaft connected to the stationary base platform and a cam follower, said cam members each having a predetermined profile for said cam follower to follow the profile of either one of the cam members to control the oscillation of the platform.

6. The simulated running target shooting system as claimed in claim 5, wherein said cam follower comprises a cylindrical shaft having two end portions with a rotary spool attached on one end portion thereof for rolling along the profile of the cam members, and a handle member attached at its opposite end portion for the marksman to select and to manually adjust the cam follower to roll along the profile of a desired cam member.

7. The simulated running target shooting system as claimed in claim 4, wherein said cam system comprises at least two rotary cams, one of said cams having a periphery larger than the other of said cams, with said cams including predetermined profiles for causing a predetermined speed of oscillation of the platform.

8. The simulated running target shooting system as claimed in claim 4, wherein said cam system comprises at least two rotary cams generally of an elliptical profile.

9. The simulated running target shooting system as claimed in claim 1, wherein said base member has a periphery generally corresponding to the periphery of said platform.

10. The simulated running target shooting system as claimed in claim 1, wherein said signaling means comprises a series of signaling members attached to a rear end portion of said platform so as to provide visual signals to a referee or an official from the rear end portion of the platform.

11. The simulated running target shooting system as claimed in claim 1, wherein said top surface of said platform further includes a horizontal table member sustained by vertically oriented support members placed near a front end portion of said platform.

12. The simulated running target shooting system as claimed in claim 1, further comprising a timed illumination means so as to illuminate said target during periods of time that a marksman is allowed to fire bullets at the target.

13. The simulated running target shooting system as claimed in claim 1, wherein said target comprises a shape in the form of a boar with scoring rings applied thereon.

14. The simulated running target shooting system as claimed in claim 1, wherein the top surface of said platform further includes an opening therein for accommodating a handle member of a cam follower so that the marksman can manually adjust the height of the cam follower to adjust the speed of oscillation of the platform.

15. The simulated running target shooting system as claimed in claim 1, and further including a signalling device comprising an audio system audible from where the marksman is positioned for providing a cue as to the period of time that the marksman is allowed to fire bullets at the target.

16. The simulated running target shooting system as claimed in claim 15, wherein said audio system comprises a sound source connected to a flexible connection finger with an electrical contact on one of its ends, said connection finger extending downwardly toward a series of spaced metallic contact projections Seated on the bottom surface of said base member, whereby when the platform oscillates, the flexible finger couples with each of the metallic contact projections and sends off an audible signal, each time the electrical contacts couple.

17. The simulated running target shooting system as claimed in claim 15, wherein said audio system is configured to sound five times before the marksman is allowed to fire bullets at the target.

18. The movable platform for simulating a running target shooting system as claimed in claim 1, comprising:

a movable platform consisting of a flat top and bottom surfaces and side panels on four sides, means rotatably supporting said platform on its bottom surface defining an axis of rotation for said platform, a stationary platform with a plurality of rollers in the space between said stationary platform and the moving platform, and a driving mechanism for causing said movable platform to rotatably oscillate about said axis of rotation:

said mechanism comprises a motor for propelling a rotary shaft having mounted on one end thereof a gear member with a series of teeth there around, the teeth on said gear member mating with teeth on a geared cam system where said motor causes said gear member to rotate said cam system comprising a cam disk having two cam members with different profiles configured in an overlaying relationship, said cam disk being seated on a cam disk shaft connected to the stationary base platform said cam members each having a predetermined profile for said cam follower to follow the profile of either one of the cam members to control the speed of the oscillation platform.

19. The movable platform for simulating a running target shooting system as claimed in claim 18, wherein said cam follower comprises a cylindrical shaft having two end portions with a rotary spool attached on one end portion thereof for rolling along the profile of the cam members, and a handle member attached at its opposite end portion for the marksman to select and to manually adjust the cam follower to roll along the profile of a desired cam member.

20. The movable platform for simulating a running target shooting system as claimed in claim 18, wherein said cam system comprises two cams, one of said cams having a periphery larger than the other of said cams.

21. The movable platform for simulating a running target shooting system as claimed in claim 18, further including a signaling device comprising a sound system audible from where the marksman is positioned for providing a cue as to the period of time that the marksman is allowed to fire bullets at the target, wherein said sound system comprises a sound source connected to a flexible connection finger with an electrical contact on one of its ends, said connection finger extending downwardly toward a series of spaced metallic contact projections seated on the bottom surface of said base member, whereby when the platform oscillates, the flexible finger couples with each of the metallic contact projections and illuminates the light each time the electrical contacts couple.

* * * * *